US010036219B1

(12) United States Patent
Sinn et al.

(10) Patent No.: US 10,036,219 B1
(45) Date of Patent: Jul. 31, 2018

(54) SYSTEMS AND METHODS FOR WELL CONTROL USING PRESSURE PREDICTION

(71) Applicant: Chevron U.S.A. Inc., San Ramon, CA (US)

(72) Inventors: Charles G. Sinn, Houston, TX (US); Raymond E. Johnston, Austin, TX (US); John Greve, Houston, TX (US); Steven J. Shipula, Houston, TX (US); Joseph D. Cavataio, Houston, TX (US); Vincent Gerard Patin, Houston, TX (US); David Lynn Rodrick, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/421,540

(22) Filed: Feb. 1, 2017

(51) Int. Cl.

| | |
|---|---|
| ***E21B 21/08*** | (2006.01) |
| ***E21B 47/06*** | (2012.01) |
| ***E21B 21/06*** | (2006.01) |
| ***G06F 17/18*** | (2006.01) |
| *E21B 33/06* | (2006.01) |

(52) U.S. Cl.
CPC ..... *E21B 21/08* (2013.01); *E21B 21/062* (2013.01); *E21B 47/06* (2013.01); *G06F 17/18* (2013.01); *E21B 33/06* (2013.01)

(58) Field of Classification Search
CPC ..... E21B 21/08
USPC ..... 175/48
See application file for complete search history.

(56) References Cited

U.S. PATENT DOCUMENTS

| | | | |
|---|---|---|---|
| 5,080,182 | A | 1/1992 | Thompson |
| 5,303,582 | A | 4/1994 | Miska |
| 6,484,816 | B1 | 11/2002 | Koederitz |
| 6,932,167 | B2 | 8/2005 | Proett et al. |

(Continued)

FOREIGN PATENT DOCUMENTS

| | | | |
|---|---|---|---|
| WO | 2006/120366 | A1 | 11/2006 |
| WO | 2009/114463 | A2 | 9/2009 |

(Continued)

OTHER PUBLICATIONS

Miska, Stefan, et al.; "Modeling of Pressure Buildup on a Kicking Well and Its Practical Application"; SPE 35245, The University of Tulsa, (1996), pp. 787-796.

*Primary Examiner* — Taras P Bemko
(74) *Attorney, Agent, or Firm* — Karen R. DiDomenicis

(57) ABSTRACT

Disclosed are systems and methods for predicting a stabilized pressure in a wellbore of a well after an undesired influx of formation fluids, i.e., a kick, into the wellbore in a real-time drilling operation. Following the kick, the well is shut in. Signals representing pressure data associated with the subterranean casing, drill pipe, wellhead, and/or the bottomhole assembly and associated time data are received in a processor. A regression analysis is performed using the pressure data and associated time data in the processor and solved for a predicted stabilized pressure associated with the subterranean casing, the drill pipe, the wellhead, and/or the bottomhole assembly respectively. The regression analysis is performed around a variant of the radial diffusivity equation describing the rate-pressure relationship for flow of a production fluid. The predicted stabilized pressure is communicated to a user.

17 Claims, 6 Drawing Sheets

(56) References Cited

U.S. PATENT DOCUMENTS

| | | | |
|---|---|---|---|
| 7,243,736 | B2 | 7/2007 | Shah |
| 7,277,796 | B2 | 10/2007 | Kuchuk et al. |
| 7,369,979 | B1 | 5/2008 | Spivey |
| 7,610,251 | B2 | 10/2009 | Shayegi |
| 7,950,472 | B2 | 5/2011 | DiFoggio et al. |
| 8,132,453 | B2 | 3/2012 | Thambynayagam et al. |
| 8,417,496 | B2 | 4/2013 | Main et al. |
| 8,528,660 | B2 | 9/2013 | Santos |
| 8,684,109 | B2 | 4/2014 | Orbell et al. |
| 8,727,037 | B1 | 5/2014 | Mouton |
| 9,163,499 | B2 | 10/2015 | Adams et al. |
| 9,262,561 | B2 | 2/2016 | Likanapaisal |
| 9,435,200 | B2 | 9/2016 | Goodwin |
| 9,436,173 | B2 | 9/2016 | Wang et al. |
| 9,471,730 | B2 | 10/2016 | Adeniji et al. |
| 9,482,084 | B2 | 11/2016 | Chang et al. |
| 2006/0069511 | A1* | 3/2006 | Thambynayagam .. G01V 99/00 702/12 |
| 2009/0084545 | A1 | 4/2009 | Banerjee et al. |
| 2009/0276156 | A1 | 11/2009 | Kragas et al. |
| 2010/0076740 | A1 | 3/2010 | Kuchuk et al. |
| 2010/0169019 | A1 | 7/2010 | Zhan et al. |
| 2011/0120702 | A1 | 5/2011 | Craig |
| 2011/0191029 | A1 | 8/2011 | Jalali et al. |
| 2011/0214882 | A1 | 9/2011 | Santos |
| 2013/0066471 | A1 | 3/2013 | Wang et al. |
| 2013/0205886 | A1 | 8/2013 | Hegeman et al. |
| 2013/0317752 | A1 | 11/2013 | Dubost et al. |
| 2014/0278302 | A1 | 9/2014 | Ziegel et al. |
| 2014/0345940 | A1* | 11/2014 | Milner ..... E21B 44/00 175/24 |
| 2015/0211339 | A1 | 7/2015 | Khan et al. |
| 2015/0235544 | A1 | 8/2015 | Hernandez et al. |
| 2015/0322775 | A1 | 11/2015 | Marland et al. |
| 2016/0003026 | A1 | 1/2016 | Adams et al. |
| 2016/0312599 | A1 | 10/2016 | Adam et al. |
| 2016/0328497 | A1 | 11/2016 | Hamza et al. |

FOREIGN PATENT DOCUMENTS

| | | | |
|---|---|---|---|
| WO | 2010/060746 | A2 | 6/2010 |
| WO | 2010/074905 | A1 | 7/2010 |
| WO | 2011/025471 | A1 | 3/2011 |
| WO | 2016/108813 | A1 | 7/2016 |
| WO | 2016/160005 | A1 | 10/2016 |

* cited by examiner

SYSTEMS AND METHODS FOR WELL CONTROL USING PRESSURE PREDICTION

FIELD

The present disclosure relates to the field of well control systems and methods, particularly for use in drilling and completions wells following a kick event in which formation fluids flow into a wellbore from the surrounding formation during operations.

BACKGROUND

As is well known, shutting in a drilling and completions well, e.g., an oil well, a gas well, a water well, a disposal well, an injection well or the like, also referred to herein as a well, is required following an undesired influx of formation fluids into the wellbore from the surrounding formation during drilling operations. This undesired influx of formation fluids is also referred to as a "kick." After shutting in the well, additional formation fluid continues to flow into the well. Conventionally drillers, also referred to herein interchangeably as rig personnel, users and operators, must keep the well shut in following a kick, i.e., after "taking a kick," until they have obtained stabilized shut in casing pressure (SICP) and shut in drill pipe pressure (SIDPP) readings. As the additional fluid flows into the well, wellbore fluid is compressed and the SICP increases until the influx stops when bottom hole pressure (BHP) equals the surrounding formation pressure. As the influx volume increases, the maximum pressure exerted at the well shoe during circulation increases. Especially when the formation surrounding the well has low permeability, there is a slow pressure build up and corresponding long pressure build up curve. Common industry well control practices require that a well remain shut in for many hours in a static condition to allow these pressures to stabilize. In some cases, this long wait period may still not generate a true stabilized SICP and SIDPP. The very gradual increase in SICP can result in choosing an inaccurate stabilized SICP and SIDPP. This can lead to circulating the well in an underbalanced state, resulting in an increase in influx size and therefore an increase in environmental and safety risks involved in a well control event. The inaccurate choices for SICP will lead to attempts by rig personnel to kill the well with improper density drilling mud, also referred to as kill weight mud (KWM), which results in additional nonproductive time. Kill weight mud is a drilling mud, also referred to as drilling fluid, having sufficient density to prevent fluids from flowing into the wellbore.

FIG. 1 is a simplified cross-sectional view illustrating a subsea well according to the prior art. A surface mud pump 2 is used to pump drilling mud into a drill pipe 6, downhole and back to the surface through a well annulus 8 and to a choke line 15. Choke line 15 includes a valve 14 for controlling flow of drilling mud there through. A number of pressure sensors are typically provided, such as drill pipe pressure sensor 4, kill line pressure sensor 16 in kill line 20, downhole pressure sensor 10 (in the downhole tools located in the wellbore), wellhead pressure sensor 18 and choke line pressure sensor 12. A pressure sensor can be located on a stand pipe manifold (not shown) for stand pipe pressure. The choke and kill pressure sensors can be located on a choke and kill high pressure manifold (not shown). FIG. 1 illustrates a subsea well, but this could also represent a land well.

There exists a need for a method of determining an accurate stabilized shut in casing pressure after shutting in a well after taking a kick to increase the safety and efficiency of the well kill.

SUMMARY

In one aspect, a method is provided for predicting a stabilized pressure in a wellbore of a well after an influx of formation fluids into the wellbore, the well comprising well components selected from the group consisting of a subterranean casing in the wellbore, a drill pipe extending from a rig located above the well and at least partially into the subterranean casing, and/or a wellhead connected to a top end of the subterranean casing. Pressure data associated with the subterranean casing, the drill pipe and/or the wellhead can be measured in real-time. Signals representing the pressure data and associated time data are received in a processor. In the processor, a regression analysis is performed using the received signals representing the pressure data and associated time data.

The regression analysis is a parametric non-linear robust fitting regression performed around a form of the radial diffusivity equation.

The processor solves for a predicted stabilized pressure associated with the subterranean casing, the drill pipe and/or the wellhead which is then communicated to a user.

In another aspect, a system is provided for predicting the stabilized pressure. The system can include one or more pressure sensors located on the subterranean casing, the drill pipe and/or the wellhead for obtaining pressure data associated with the subterranean casing, the drill pipe and/or the wellhead, a processor for receiving signals representing the pressure data from the one or more pressure sensors and associated time data, and for performing a regression analysis using the received signals, and an output means for communicating the predicted stabilized pressure to a user.

BRIEF DESCRIPTION OF THE DRAWINGS

These and other objects, features and advantages of the present invention will become better understood with reference to the following description, appended claims and accompanying drawings. The drawings are not considered limiting of the scope of the appended claims. The elements shown in the drawings are not necessarily to scale. Reference numerals designate like or corresponding, but not necessarily identical, elements.

DETAILED DESCRIPTION

Figure 1:
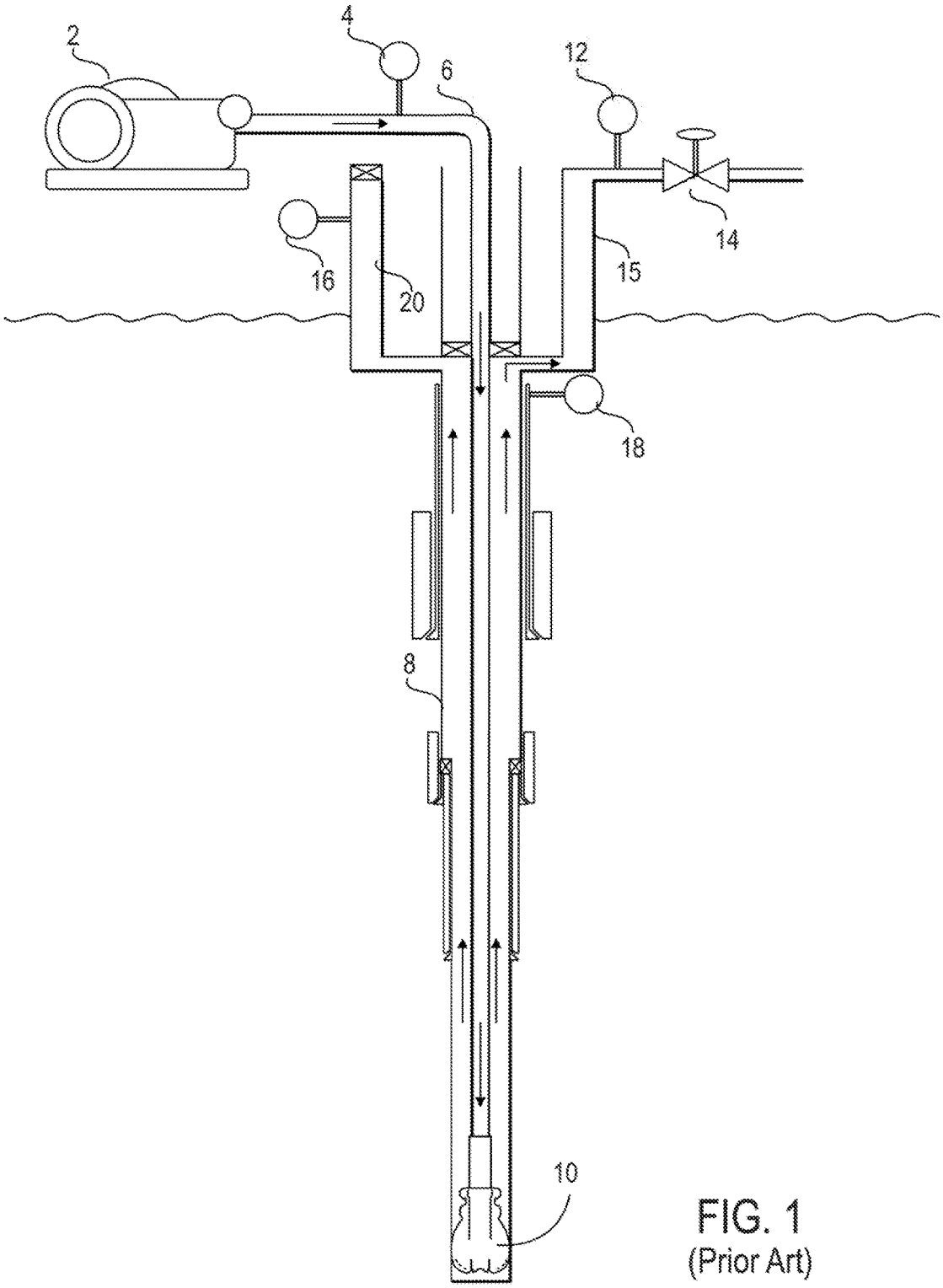
FIG. 1 (Prior Art)
FIG. 1 is a simplified cross-sectional view illustrating a subsea well according to the prior art.

The methods of the present disclosure use predictive curve fitting to predict stabilized pressure, such as, but not limited to, bottomhole pressure, SIDPP and SICP, after a well kick or an influx based on a best fit curve or model resulting from a regression analysis. The regression analysis can use real-time pressure data. Curve fitting is a process used in predictive analytics in which a curve is created that graphically depicts the mathematical relationship that best fits the actual data points in a data series.

The amount of data needed to determine an accurate prediction depends highly on the formation permeability and the variability thereof. In many cases this best fit curve or model will use only a fraction of the time needed to establish stabilized SIDPP and SICP values using current well control practices. This best fit model uses a variant of the radial diffusivity equation that relates pressure and flow, also referred to as the model. The radial diffusivity equation is a well-known mathematical relationship derived from Darcy's Law that describes the flow of a fluid through a porous medium and equations of state that describe the properties of the fluid at given conditions. By "variant" is meant any equation derived from the radial diffusivity equation by making assumptions for the terms of the equation. In one embodiment, the best fit model evaluates the rate of buildup of the shut in casing pressure (SICP) and predicts the final stabilized SICP as well as the final stabilized shut in drill pipe pressure (SIDPP). The model is not necessarily specific to infinite-acting radial flow. In some embodiments, the model performs this prediction while using 10-15% of the time typically needed to establish these stabilized pressures using conventional well control pressure stabilization methods. In some embodiments, a best fit curve with an R-squared fit over 99.5% is used which results in predicted kill weight mud accuracy (certainty range) of +/−0.1 ppg and even +/−0.05 ppg. This best fit curve can be used in conjunction with currently available well control modeling software. Combined they can provide a graphical display for rig personnel or drilling teams to see real-time BHP and predicted KWM to assist in planning well kill operations.

In one embodiment, a method is provided for predicting a stabilized pressure in a wellbore of a well after an undesired influx of formation fluids into the wellbore. The method is especially suitable for use after shutting in a well after taking a kick.

The well includes well components such as a subterranean casing in the wellbore, a drill pipe extending from a rig located above the well and at least partially into the subterranean casing, and/or a wellhead connected to a top end of the subterranean casing.

After having taken a kick, the wellbore will generally be in an undesired underbalanced condition. In one embodiment, drilling mud is injected into the wellbore thereby reducing the influx of formation fluids into the wellbore.

Pressure data associated with the subterranean casing, the drill pipe and/or the wellhead is measured. When the pressure data is associated with the subterranean casing, it can be measured at a surface location on a choke line or manifold associated with the casing using a choke pressure transducer, a surface location on a kill line or manifold associated with the casing using a kill pressure transducer, and/or a downhole location within the casing using a downhole pressure transducer. When the pressure data is associated with the drill pipe, it can be measured at a surface location by a pressure transducer connected to the drill pipe. The pressure transducer can be located on a stand pipe on the rig and connected to the drill pipe. When the pressure data is associated with the wellhead, it can be measured at a blowout preventer pressure gauge located on the wellhead. The pressure transducers used can be capable of detecting and transmitting real-time pressures to a processor. Signals representing the pressure data and associated time data are received in the processor.

The pressure data can be measured in real-time. When real-time data is not available, operators have the alternative option of requesting an electronic file of the pressure data by any suitable transmission means and manually importing or inputting the pressure data and associated time data into the processor.

In the processor, a regression analysis is performed using the received signals representing the pressure data and its associated time data. The regression analysis is performed using any suitable software for statistical regression or two dimensional linear and non-linear curve fitting.

The regression analysis is a parametric non-linear robust fitting regression performed around a variant of the radial diffusivity equation, i.e. the best fit model. The regression analysis fits a parametric non-linear model to a variant of the radial diffusivity equation using a method that is robust to outliers. The non-linear regression model can be fit with a variety of analytical techniques, including, but not limited to, least squares, least absolute deviation, Lorentzian and Pearson's correlation coefficient. The approach finds the best fit by adjusting the values of unknown model parameters until the model fits the data more closely. The best fit model is a derivation of the diffusivity equation where assumptions are made to reduce the complexity of the solution. In one embodiment, the best fit model is a variant of the diffusivity equation using a component to solve for wellbore storage.

In one embodiment, the best fit model assumes that oil based mud is used downhole. In one embodiment, the best fit model assumes that the bubble point is less than the mud weight absolute pressure at the BOP stack on the sea floor.

In one embodiment, the best fit model can be derived from Equation 1 as follows:

$$P(t)=P_i-(162.6*\mu/kh)Q_1B\times\log((C+\Delta t)/\Delta t)-(162.6*\mu/kh)Q_2B\times\log((E+\Delta t)/\Delta t) \quad (1)$$

wherein:

P(t) is a measured pressure associated with the subterranean casing, the drill pipe, the wellhead, and/or the bottomhole assembly in psi at a time tin hours;

$P_i$ is P(t) extrapolated to infinite time;

C is a pseudo injection time at flow rate $Q_1$ in hours;

E is a pseudo production time at flow rate $Q_2$ in hours;

k is the permeability of the formation in millidarcies;

h is the thickness of the formation in feet;

μ is the viscosity of the formation fluid in cp;

$Q_1$ is a pseudo injection flow rate, in stock tank barrels/day;

$Q_2$ is a production flow rate, in stock tank barrels/day;

B is the formation volume factor in reservoir barrels/stock tank barrels; and

Δt is an increment of time in hours.

Before a well is shut in, the flow rate at the formation sandface is equal to the produced fluid flow rate measured on surface. $Q_2$ is the produced fluid flow rate and represents the actual flow rate during the well kick. When a well is shut in at surface, the produced fluid flow rate measured at surface immediately goes to zero, yet the flow of formation fluid at the sandface continues. At this time, wellbore fluids are compressed causing the shut in pressure to increase. The flow of formation fluids after shut in is known as after-flow or wellbore storage. After-flow dominates the initial pressure response after shut in. The inventors propose this early shut in pressure response dominated by after-flow can be modeled by introducing a pseudo-injection rate, $Q_1$, for a short time period before shut in. The pseudo-injection rate represents a single step change in flow rate before shut in and is used to approximate the logarithmic decay in the sandface flow rate after shut in.

Figure 2:
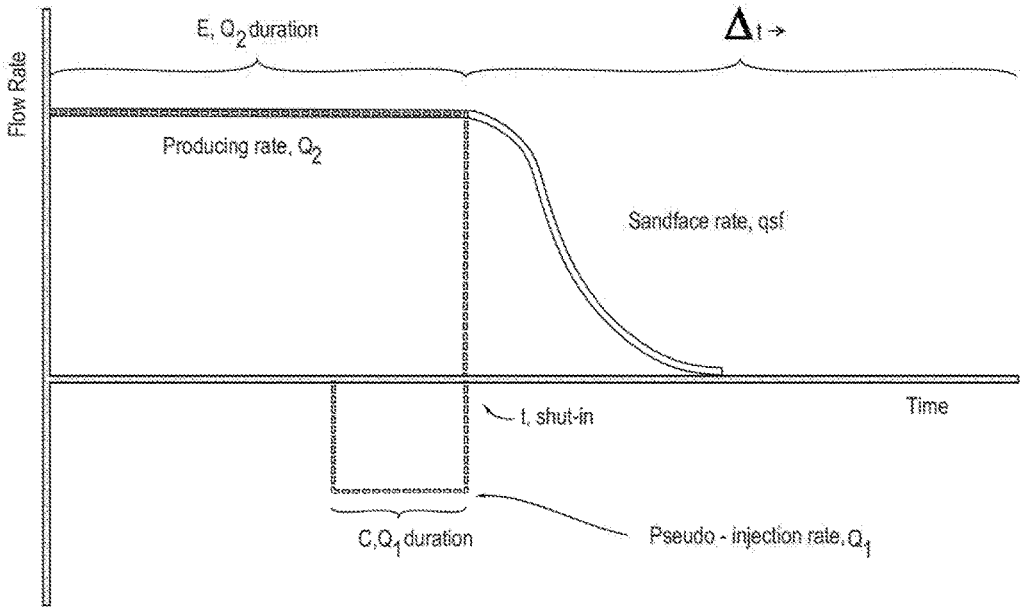
FIG. 2 is a plot illustrating a relationship between flow rate and time according to an exemplary embodiment.

FIG. 2 is a plot illustrating a relationship between flow rate and time according to an exemplary embodiment. The produced fluid flow rate, $Q_2$, pseudo-injection flow rate, $Q_1$, and the sandface flow rate after shut in, qsf, are all disturbances which cause a specific pressure response at well shut in.

The model equation has two slope parameters which allows for curve fitting the stretched S-shape curve on a semi-log plot commonly seen in well shut in events. C represents the amount of time that the term $(162.6*\mu/kh)Q_1B\times\log((C+\Delta t/\Delta t)$ has an effect on P(t). Similarly, E represents the amount of time that the term $(162.6*\mu/kh)Q_2B\times\log((E+\Delta t/\Delta t)$ has an effect on P(t).

Equation 1 can also be expressed as follows:

$$P(t)=A-B\times\log((C+\Delta t)/\Delta t)-D\times\log((E+\Delta t)/\Delta t);$$

wherein:

P(t) is a measured pressure associated with the subterranean casing, the drill pipe, the wellhead, and/or the bottomhole assembly in psi at a time tin hours;

A is P(t) extrapolated to infinite time;

B is a constant that represents reservoir and flow properties;

C is a pseudo injection time in hours;

D is a constant that represents reservoir and flow properties;

E is a pseudo production time in hours; and

Δt is an elapsed time in hours past well shut in.

In another embodiment, the variant of the radial diffusivity equation used in the disclosed method is:

$$P(t)=A-B\times\log((C+\Delta t)/\Delta t).$$

wherein:

P(t) is a measured pressure associated with the subterranean casing, the drill pipe, the wellhead, and/or the bottomhole assembly in psi at a time tin hours;

A is P(t) extrapolated to infinite time;

B is a constant that represents reservoir and flow properties;

C is a production time in hours; and

Δt is an elapsed time in hours past well shut in.

In one embodiment, the following steps are conducted. First, real-time pressure data is received by the processor and imported into the regression analysis software. The real-time pressure data can be imported on some frequency, not necessarily in real-time.

In one embodiment, the regression analysis is started around the variant above of the radial diffusivity equation using an initial best estimate for A. In one embodiment, the initial best estimate is the last pressure in the data set. In one nonlimiting embodiment, a minimum value for A is set to 50 psi below the initial best estimate. In one embodiment, a maximum value for A is set to 2000 psi. B and D values are slope parameters. In one embodiment, B is negative and D is positive. In one nonlimiting embodiment, the regression analysis is started using B and D values of +/−100, and increasing these values on each iteration. C and E values are injection and production time parameters, respectively. In one embodiment, C and E values are under 0.5 hours. In one embodiment, C and E values are started at 0.1 and increased by 1 on each iteration. C and E values can be adjusted after first making adjustments to A, B, and/or D parameters.

The amount of pressure data needed can depend on several factors. In some embodiments, outlier data which are unrelated to a reservoir pressure response can be eliminated or filtered by the operator running the program. Such outliers are typically highlighted graphically on the curve generated by the regression analysis software. The operator running the program can determine whether the identified data outliers are not matching the model due to other influences unassociated with reservoir pressure, e.g., data resulting from mechanical actions after shut-in. The regression analysis can then be performed again without the outliers. The equation is used then to solve for the predicted stabilized pressure, which is the SICP extrapolated to infinite time.

The higher the R-squared and lower the P-value values, the narrower the prediction interval bands. In one embodiment, regression yielding an R-squared value of greater than 0.995 and a P-value of less than 0.0001 can be accepted. In one embodiment, a 99.99% prediction interval is determined, i.e., the pressure range within which the stabilized pressure will fall 99.99% of the time at extrapolation to a time greater than at least 24 hours, even at least 100 hours and even at least 1000 hours. Acceptable prediction interval threshold will be set to a maximum error window of 0.1 ppg with 99.99% probability.

In one embodiment, the following Table can be referenced to look up acceptable error of the predicted stabilized pressure (i.e., +/−PSI), which is 0.0052*TVD. The predicted stabilized pressure result can be compared to the acceptable error for the given True Vertical Depth (TVD), shown in feet. The TVD is the vertical distance from the rig floor to the bottom hole. As a diagnostic, if the predicted stabilized pressure falls within this error, this confirms that the regression has run or iterated long enough. If not, the iterations continue and/or additional pressure data is incorporated into the analysis until an acceptable solution is obtained.

| TVD | Acceptable error PSI +/− |
|---|---|
| 10000 | 52 |
| 10500 | 54.6 |
| 11000 | 57.2 |
| 11500 | 59.8 |
| 12000 | 62.4 |
| 12500 | 65 |
| 13000 | 67.6 |
| 13500 | 70.2 |
| 14000 | 72.8 |
| 14500 | 75.4 |
| 15000 | 78 |
| 15500 | 80.6 |
| 16000 | 83.2 |
| 16500 | 85.8 |
| 17000 | 88.4 |
| 17500 | 91 |
| 18000 | 93.6 |
| 18500 | 96.2 |
| 19000 | 98.8 |
| 19500 | 101.4 |
| 20000 | 104 |
| 20500 | 106.6 |
| 21000 | 109.2 |
| 21500 | 111.8 |
| 22000 | 114.4 |
| 22500 | 117 |
| 23000 | 119.6 |
| 23500 | 122.2 |
| 24000 | 124.8 |
| 24500 | 127.4 |
| 25000 | 130 |
| 25500 | 132.6 |
| 26000 | 135.2 |
| 26500 | 137.8 |
| 27000 | 140.4 |
| 27500 | 143 |
| 28000 | 145.6 |
| 28500 | 148.2 |
| 29000 | 150.8 |
| 29500 | 153.4 |
| 30000 | 156 |
| 30500 | 158.6 |
| 31000 | 161.2 |

-continued

| TVD | Acceptable error PSI +/− |
|---|---|
| 31500 | 163.8 |
| 32000 | 166.4 |
| 32500 | 169 |
| 33000 | 171.6 |
| 33500 | 174.2 |
| 34000 | 176.8 |
| 34500 | 179.4 |
| 35000 | 182 |
| 35500 | 184.6 |
| 36000 | 187.2 |
| 36500 | 189.8 |
| 37000 | 192.4 |
| 37500 | 195 |
| 38000 | 197.6 |
| 38500 | 200.2 |
| 39000 | 202.8 |
| 39500 | 205.4 |
| 40000 | 208 |
| 40500 | 210.6 |
| 41000 | 213.2 |
| 41500 | 215.8 |
| 42000 | 218.4 |
| 42500 | 221 |

In one embodiment, an output means is used for communicating the predicted stabilized pressure to a user or operator. The output means can be any suitable means, including, but not limited to, an indication on a graphical user interface on a monitor, an audible message through a speaker, an email to the user, a text message to the user and a phone call.

The predicted stabilized pressure determined by the regression analysis can be used to determine a new mud density of a drilling mud, also referred to as drilling fluid, needed to balance pressure in the wellbore. Any known means for adjusting a mud density can be used, such as adjusting the composition, e.g., by adding a weighting agent to the drilling mud composition. The drilling mud is circulated using common well control techniques into the wellbore thereby stopping the influx of formation fluids into the wellbore. The well can be any well, e.g., but not limited to, a deepwater well, a land well or a shallow water well.

The results can be used to calculate mud density using the following equation:

Equivalent Mud Weight=(hydrostatic pressure+shut in pressure)/TVD

In one embodiment:

Equivalent Mud Weight in ppg=(hydrostatic pressure in psi+shut in pressure in psi)/0.052/TVD in ft.

The results can be used to calculate formation pressure using the following equation:

Formation Pressure=hydrostatic pressure+shut in pressure

In one embodiment:

Formation Pressure in ppg=shut in pressure in psi/0.052/TVD in ft+Equivalent Static Density measured before the kick in ppg In one embodiment, results within a +/−0.1 ppg mud density range, even within a +/−0.05 ppg mud density range can be accepted.

Thus the operator can with 99% confidence predict the SICP and the SIDPP and the KWM required to balance the well.

There are several benefits of predicting stabilized SIDPP and SICP values before these pressures naturally stabilize. Determining the correct stabilized SICP and SIDPP allows rig personnel to confidently select the proper KWM the first time, reducing overall well control circulating time and improving the overall safety and efficiency of the well control operation. Additionally, using a SICP prediction, inducing a stabilized pressure from surface, and starting a well kill before the casing pressure has naturally stabilized will reduce the influx that is drawn into the wellbore. This in turn will reduce the pressures that are exerted on the casing shoe, i.e., the bottom of the casing, during the first drilling mud circulation, and will reduce the chances of exceeding the Maximum Initial Shut In Casing Pressure (MISICP) potentially causing formation fracturing at the casing shoe when the well is shut in. Furthermore, starting a well kill before the casing pressure has naturally stabilized will reduce the static wait time of the rig's drilling string, thus mitigating the potential for wellbore instability and stuck pipe problems.

In drilling, an acceptable mud density accuracy is within a +/−0.1 ppg range. It has been repeatedly demonstrated that the method can drastically reduce well control operation time by accurately predicting KWM within this acceptable range. Given the high day rate cost of offshore floating drilling rigs, significant cost savings can be achieved using the predictive method of the disclosure.

EXAMPLES

In each of the following examples, a custom equation (user-defined function) in a curve-fitting software was set up in the format:

$$P(t)=A-B\times\log((C+\Delta t)/\Delta t)-D\times\log((E+\Delta t)/\Delta t);$$

wherein:

P(t) is a measured pressure associated with the subterranean casing, the drill pipe, the wellhead, and/or the bottomhole assembly in psi at a time tin hours;

A is P(t) extrapolated to infinite time;

B is a constant that is not known and represents reservoir and flow properties;

C is a pseudo injection time in hours and mathematically is the amount of time that the term $B\times\log((C+\Delta t)/\Delta t)$ has an effect on P(t);

D is a constant that is not known and represents reservoir and flow properties;

E is a pseudo producing time in hours and mathematically is the amount of time that the term $D\times\log((E+\Delta t)/\Delta t)$ has an effect on P(t); and $\Delta t$ is an elapsed time in hours past well shut in.

The user-defined function corresponds to Equation 1 herein, i.e., a variant of the radial diffusivity equation.

The following steps were then conducted for each of the examples:

1. Import available real-time pressure data into the curve-fitting software.
2. Quality check pressure data and remove data not representing a reservoir pressure response.
3. Run a non-linear regression analysis on the imported real-time pressure data using the user-defined function with initial estimate parameters.
4. Using curve-fitting software, calculate and review non-linear regression analysis diagnostics R-squared, P-value, and the 99.99% prediction interval.
5. Iterate on the initial user defined function initial estimate parameters until the curve fit diagnostics can no longer be improved. Begin initial adjustments using A, B, and D parameters. Then make any final adjustments to the C and E parameters.

6. Determine if curve-fit diagnostics pass the following criteria:
   a. R-squared must be greater than 0.995 to validate curve-fit
   b. P-value must be less than 0.0001 to validate curve-fit
   c. 99.99% probability predication interval at 24 hour extrapolation must be less than the acceptable error defined by the equation 0.0052*Well TVD
7. If curve-fit diagnostics fail criteria, reevaluate raw data and exclude any data intervals that are unrepresentative of a reservoir pressure response.
8. Run a final non-linear regression analysis and confirm curve fit diagnostics pass criteria.
9. The A value will be the pressure extrapolated to infinite time (i.e., the predicted stabilized pressure).
10. Using the curve-fitting software, calculate the 99.99% prediction interval at Δt equal to 24 hours to determine the most probable minimum and maximum range for A.

Example 1

While drilling an offshore oil well, a drill pipe stand connection was made at 27,434 feet measured depth (MD)/26,390 feet TVD and an estimated 15 bbl gain was observed at the surface trip tanks indicating a kick. The well was shut-in. Active surface mud pit trends indicated the well likely started to kick while drilling at 27,400 feet MD with an Equivalent Circulating Density (ECD) of 15.53 ppg. Given that the kick started while drilling, the kick zone formation pressure was likely above this ECD value. Before the kick, the surface mud weight (MW) was measured to be 15.1 ppg and the last measured Equivalent Static Density (ESD) was 15.37 ppg.

Figure 3:
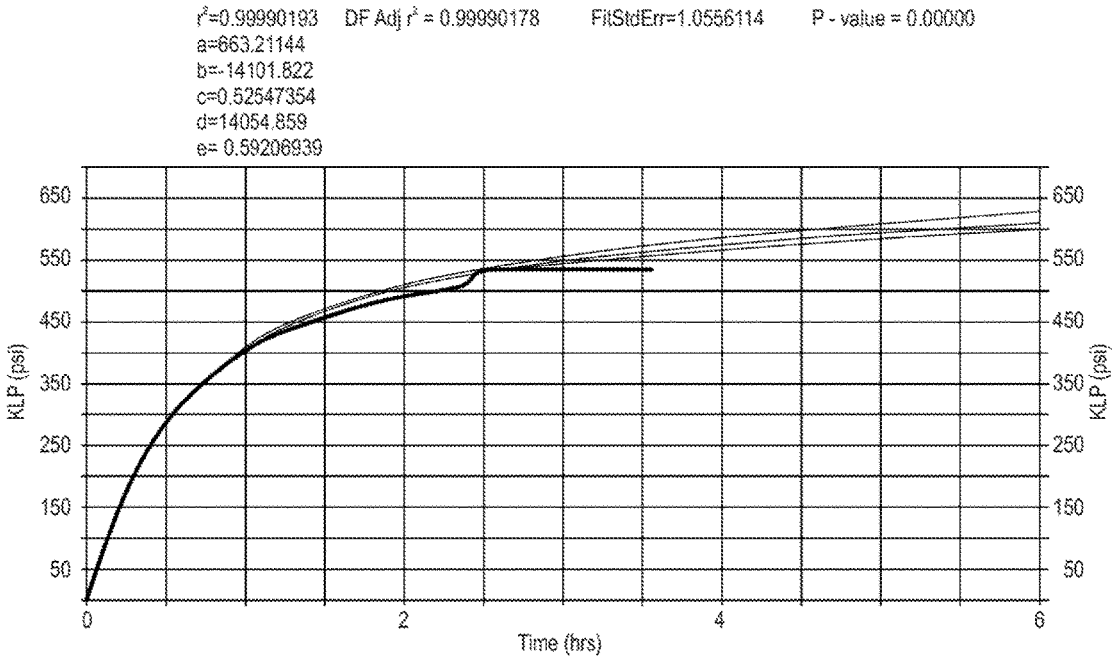
FIGS. 3-6 are plots illustrating a relationship between shut-in pressure and time according to exemplary embodiments.

As can be seen from FIG. 3, using less than an hour of pressure buildup data, the disclosed method was used in real-time to predict a stabilized kill line pressure (KLP). Actual pressure data is represented by the heavy line. The actual pressure buildup curve includes fluctuations where manual changes were made on the rig, e.g., the pressure was manually bled down with valves at 1.5 hours and pressure was manually increased by pumping down the drill pipe at 2.4 hours. The predicted pressure curve is represented by the thin, smooth lines. Three lines are given for the predicted pressure curve as shown, representing a most likely value, a high value and a low value. The regression analysis outputs are shown. The $R^2$ value passes the criteria (0.99990193>0.995) and the P-value passes the criteria (0.00000<0.0001). The predicted pressure value was extrapolated to time 24 hours once a statistical fit was achieved. The 99.99% prediction interval at 24 hours was 640 psi-655 psi. This range of 15 psi was then compared to the Table at the TVD closest to 26,390 feet to confirm that the error range is acceptable and the solution is stable. According to the Table, at a TVD of 26,500, an acceptable error range is 137.8. Since 15 is well within this range (since 15 is less than 137.8), the error range is acceptable and the solution is stable.

Assuming only a negligible loss in hydrostatic pressure due to lighter influx fluid entering the wellbore and displacing heavier drilling mud during the kick, the most probable range of formation pressure was determined to be 15.84 ppg-15.85 ppg (calculated as 640 psi/0.052/26,390 feet TVD plus the last measured ESD of 15.37 ppg and 655 psi/0.052/26,390 feet TVD plus the last measured ESD of 15.37 ppg). Given the most probable formation pressure, a KWM of 15.6 ppg would therefore likely balance the well.

Rig personnel circulated the well with a 15.3 ppg KWM resulting in an estimated ESD of 15.56 ppg. After circulating the 15.3 ppg KWM, the well was shut in and surface pressures continued to increase signifying that the well was still underbalanced.

Rig personnel then circulated the well with a 15.6 ppg KWM resulting in an estimated ESD of 15.88 ppg. After the well control operation, the well was observed to be static at the surface trip tanks.

Figure 4:
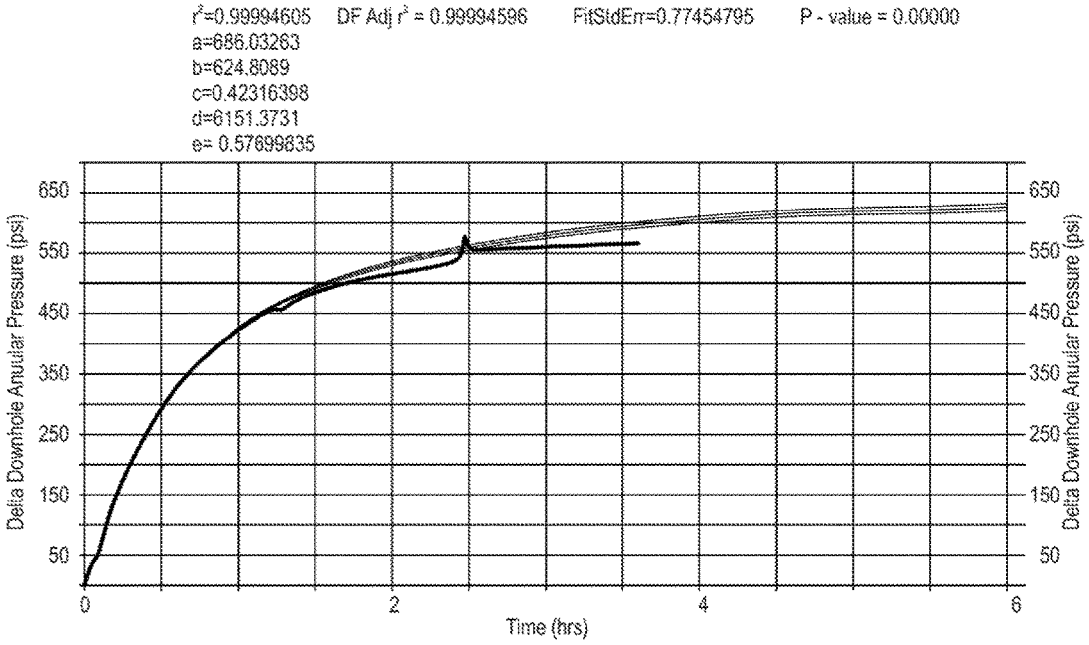

The disclosed method was also performed using recorded mode downhole annular pressure data for the same well. As can be seen from FIG. 4, delta downhole annular pressure, meaning the pressure difference between two times (i.e., shut-in time and Δt) was plotted against time. The predicted pressure value was extrapolated to time 24 hours once a statistical fit was achieved. The 99.99% prediction interval at 24 hours was 662 psi-678 psi. The final analyses performed on the real-time kill line pressure and the recorded mode downhole annular pressure datasets yielded substantially equivalent results.

Example 2

While drilling an offshore oil well, a drill pipe stand connection was made at 20,919 feet TVD and an estimated 5.5 bbl gain was observed at the surface trip tanks indicating a kick. The well was shut in. Before the kick, the surface MW was measured to be 14.2 ppg and the last measured Equivalent Static Density (ESD) was 14.55 ppg.

Figure 5:
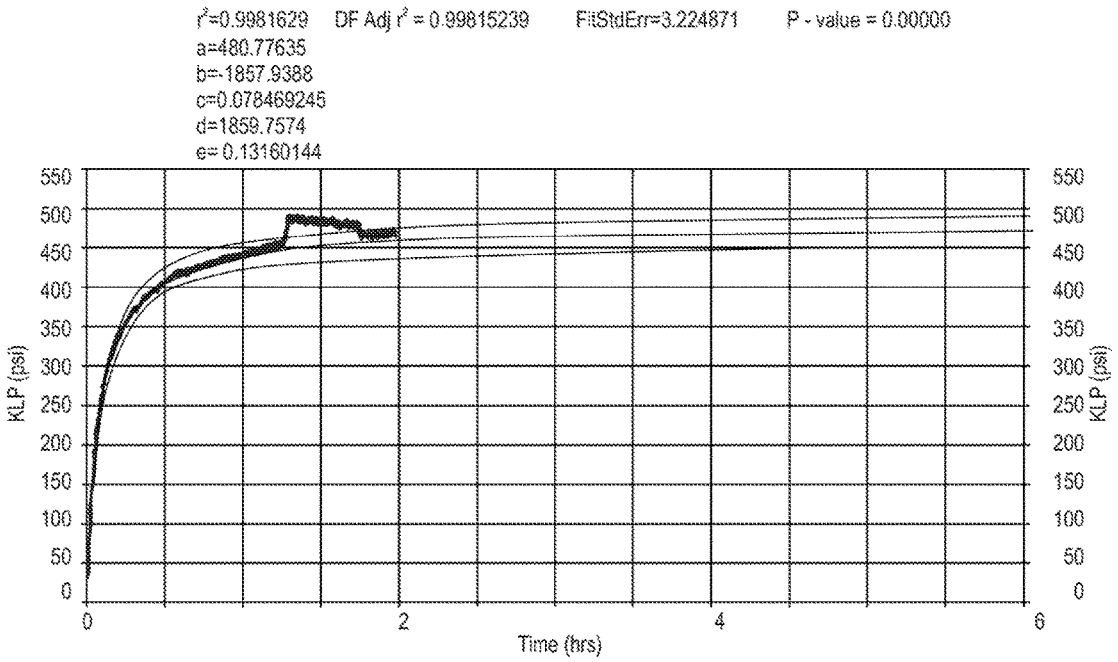

As can be seen from FIG. 5, using only 0.5 hour of pressure buildup data, the disclosed method was used in real-time to predict a stabilized kill line pressure. Again, actual pressure data is represented by the heavy line. The actual pressure buildup curve includes fluctuations where manual changes were made on the rig, i.e., the pressure was manually increased by pumping down the drill pipe at roughly 1.5 hours. The predicted pressure curve is represented by the thin, smooth lines. Three lines are given for the predicted pressure curve as shown, representing a most likely value, a high value and a low value. The regression analysis outputs are shown. The $R^2$ value passes the criteria (0.9981629>0.995) and the P-value passes the criteria (0.00000<0.0001)). The predicted pressure value was extrapolated to time 24 hours once a statistical fit was achieved. The 99.99% prediction interval at 24 hours was 455 psi-503 psi. This range of 48 psi was then compared to the Table at the TVD closest to 20,919 feet and it was confirmed that the error range is acceptable and the solution is stable.

Once the kill line pressure stabilized, the float was bumped evidencing a 66 psi loss in hydrostatic pressure on the annulus side due to the lighter influx fluid entering the wellbore and displacing heavier drilling fluid during the kick. The observed 66 psi differential in hydrostatic pressure between the annulus and drill pipe was subtracted from the stabilized kill line pressure prediction to determine a final estimated range of formation pressure between 14.91 ppg and 14.95 ppg. Given the final estimated range of formation pressure, it was recommended to circulate a 14.7 ppg KWM to balance the well.

Rig personnel circulated the well with a 14.6 ppg KWM resulting in an estimated ESD of 14.9 ppg. After the well control operation, the well was observed to be static at the surface trip tanks.

After drilling additional footage, real-time pressure tests were performed in the kick zone. Real-time pressure tests measured the kick zone formation pressure to be between 14.91 ppg and 14.94 ppg which matched closely to the predicted formation pressure using the disclosed method. After real-time pressure tests confirmed the formation pressure, drilling operations were suspended to circulate the wellbore with 14.7 ppg surface MW.

Example 3

While drilling an offshore oil well, a drill pipe stand connection was made at 29,381 feet TVD and an estimated 5.1 bbl gain was observed at the surface trip tanks indicating a kick. The well was shut in. Before the kick, the surface MW was measured to be 15.7 ppg and the last measured Equivalent Static Density (ESD) was 15.91 ppg.

Figure 6:
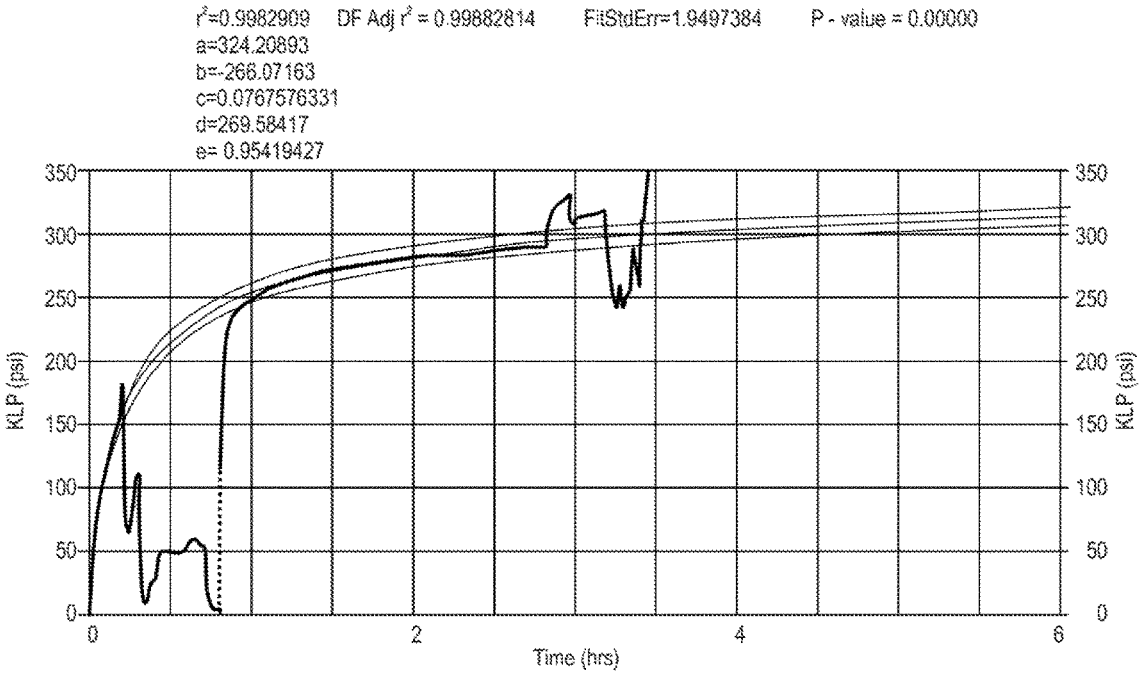

As can be seen from FIG. 6, using only 2.5 hours of pressure buildup data, the disclosed method was used in real-time to predict a stabilized kill line pressure. Again, actual pressure data is represented by the heavy line. The actual pressure buildup curve includes fluctuations reflecting the closing of the BOP stack valves to flush choke and kill lines within the first hour, and pumping down the drill pipe at roughly 2.8 hours. The predicted pressure curve is represented by the thin, smooth lines. Three lines are given for the predicted pressure curve as shown, representing a most likely value, a high value and a low value. The regression analysis outputs are shown. The $R^2$ value passes the criteria (0.99882909>0.995) and the P-value passes the criteria (0.00000<0.0001). The predicted pressure value was extrapolated to time 24 hours once a statistical fit was achieved. The 99.99% prediction interval at 24 hours was 312 psi-328 psi. This range of 16 psi was then compared to the Table at the TVD closest to 29,381 feet and it was confirmed that the error range is acceptable and the solution is stable.

Once the kill line pressure stabilized, the float was bumped evidencing a 134 psi loss in hydrostatic pressure on the annulus side due to the lighter influx fluid entering the wellbore and displacing heavier drilling fluid during the kick. The observed 134 psi differential in hydrostatic pressure between the annulus and drill pipe was subtracted from the stabilized kill line pressure prediction to determine a final estimated range of formation pressure between 16.03 ppg and 16.04 ppg. Given the final estimated range of formation pressure, it was recommended to circulate a 15.9 ppg KWM to balance the well.

Rig personnel circulated the well with a 16.0 ppg KWM resulting in an estimated ESD of 16.2 ppg. After the well control operation, the well was observed to be static at the surface trip tanks.

After drilling additional footage, real-time pressure tests were performed in the kick zone. Real-time pressure tests measured the kick zone formation pressure to be 16.10 ppg which matched closely to the predicted formation pressure using the disclosed method.

FIGS. 3-6 illustrate regression curve fits for actual pressure build ups. As can be seen, all have high statistical significance. Outlier data not representing a reservoir pressure response were excluded from the regression analyses. In some cases, the data range used in the regression analysis was limited to demonstrate that the disclosed method can reliably and accurately predict (within a certain +/−psi range) future pressure build-up responses.

It should be noted that only the components relevant to the disclosure are shown in the figures, and that many other components normally part of a well system are not shown for simplicity.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A method for predicting a stabilized pressure in a wellbore of a well after an undesired influx of formation fluids into the wellbore in a real-time drilling operation, the well comprising well components selected from the group consisting of a subterranean casing in the wellbore, a drill pipe extending from a rig located above the well and at least partially into the subterranean casing, a wellhead connected to a top end of the subterranean casing, a bottomhole assembly and combinations thereof, comprising:

a. following the influx of formation fluids into the wellbore in the real-time drilling operation such that the wellbore is in an undesired underbalanced condition, shutting in the well;

b. receiving signals representing pressure data associated with the subterranean casing, the drill pipe, the wellhead, and/or the bottomhole assembly and associated time data in a processor;

c. performing a regression analysis using the received signals representing the pressure data and the associated time data in the processor and solving for a predicted stabilized pressure associated with the subterranean casing, the drill pipe, the wellhead, and/or the bottomhole assembly respectively, wherein the regression analysis is performed around a variant of a radial diffusivity equation describing a rate-pressure relationship for flow of a production fluid;

d. communicating the predicted stabilized pressure to a user; and e. using the predicted stabilized pressure to determine a mud density of a drilling mud needed to balance pressure in the wellbore.

2. The method of claim 1, further comprising forming the drilling mud having the mud density; and circulating the drilling mud into the wellbore during a well kill operation thereby balancing pressure in the wellbore.

3. The method of claim 2, wherein the wellbore is in the underbalanced condition after an influx of formation fluids into the wellbore; and wherein circulating the drilling mud into the wellbore prior to balancing pressure in the wellbore reduces the influx of formation fluids into the wellbore.

4. The method of claim 1, wherein the variant of the radial diffusivity equation is as follows:

$$P(t)=A-B\times\log((C+\Delta t)/\Delta t)-D\times\log((E+\Delta t)/\Delta t);$$

wherein:

a. P(t) is a measured pressure associated with the subterranean casing, the drill pipe, the wellhead, and/or the bottomhole assembly in psi at a time t in hours;

b. A is P(t) extrapolated to infinite time;

c. B is a constant that represents reservoir and flow properties;

d. C is a pseudo injection time in hours:

e. D is a constant that represents reservoir and flow properties;

f. E is a pseudo producing time in hours; and g. Δt is an elapsed time in hours past well shut in.

5. The method of claim 1, wherein the variant of the radial diffusivity equation is as follows:

$$P(t)=A-B\times\log((C+\Delta t)/\Delta t);$$

wherein:

a. P(t) is a measured pressure associated with the subterranean casing, the drill pipe, the wellhead, and/or the bottomhole assembly in psi at a time t in hours;

b. A is P(t) extrapolated to infinite time;

c. B is a constant that represents reservoir and flow properties;

d. C is a pseudo producing time in hours; and e. Δt is an elapsed time in hours past well shut in.

6. The method of claim 1, wherein the well is an oil and gas well.

7. The method of claim 1, wherein the pressure data associated with the casing is measured at a location selected from the group consisting of a surface location on a choke line, a surface location on a kill line, a downhole location within an annulus within the subterranean casing and combinations thereof.

8. The method of claim 1, wherein the pressure data associated with the drill pipe is measured at a surface location by a pressure transducer connected to the drill pipe.

9. The method of claim 1, wherein the pressure data associated with the wellhead is measured at a blowout preventer pressure gauge located on the wellhead.

10. The method of claim 1, wherein the received signals of pressure data are monitored in real-time.

11. A system for predicting a stabilized pressure in a wellbore of a well after an undesired influx of formation fluids into the wellbore in a real-time drilling operation, the well comprising well components selected from the group consisting of a subterranean casing in the wellbore, a drill pipe extending from a rig located above the well and at least partially into the subterranean casing, a wellhead connected to a top end of the subterranean casing, a bottomhole assembly and combinations thereof, comprising:

a. a processor for receiving signals representing pressure data associated with the subterranean casing, the drill pipe, the wellhead, and/or the bottomhole assembly and associated time data, performing a regression analysis using the received signals, and solving for a predicted stabilized pressure associated with the subterranean casing, the drill pipe, the wellhead, and/or the bottomhole assembly, respectively, wherein the regression analysis is performed around a variant of a radial diffusivity equation describing a rate-pressure relationship for flow of a production fluid;

b. an output means for communicating the predicted stabilized pressure to a user; and c. a source of drilling mud capable of being adjusted based on the predicted stabilized pressure and circulated into the wellbore to balance the pressure in the wellbore during the well kill operation.

12. The system of claim 11, further comprising a mud pump for circulating the drilling mud into the wellbore to balance pressure in the wellbore.

13. The system of claim 11, wherein the well is an oil and gas well.

14. The system of claim 11, wherein the one or more pressure sensors for obtaining pressure data associated with the subterranean casing are located at a location selected from the group consisting of a surface location on a choke line, a surface location on a kill line, a downhole location within an annulus within the subterranean casing and combinations thereof.

15. The system of claim 11, wherein the one or more pressure sensors for obtaining pressure data associated with the drill pipe comprise one or more pressure transducers connected to the drill pipe at a surface location.

16. The system of claim 11, wherein the one or more pressure sensors for obtaining pressure data associated with the wellhead comprises a blowout preventer pressure gauge located on the wellhead.

17. The system of claim 11, further comprising one or more pressure sensors located on the subterranean casing, the drill pipe and/or the wellhead for obtaining the pressure data associated with the subterranean casing, the drill pipe and/or the wellhead in real-time.

* * * * *